United States Patent [19]

McGee et al.

[11] Patent Number: 4,507,548

[45] Date of Patent: Mar. 26, 1985

[54] INDICATOR ASSEMBLY FOR USE WITH NUMBER WHEEL

[75] Inventors: Thomas G. McGee, Simsbury; Richard L. Hockmuth, Avon, both of Conn.

[73] Assignee: Petroleum Meter & Pump Co., Ind., Avon, Conn.

[21] Appl. No.: 496,081

[22] Filed: May 19, 1983

[51] Int. Cl.[3] ..... G06C 15/42; B67D 5/22

[52] U.S. Cl. ..... 235/94 R; 235/1 D; 235/117 R

[58] Field of Search ..... 235/94 R, 94 A, 117 R, 235/117 A, 1 D, 118-122; 116/302, 306, 307, 309, 327, 328, 331, 332; 222/23, 24

[56] References Cited

U.S. PATENT DOCUMENTS

| | | | |
|---|---|---|---|
| 3,618,852 | 11/1971 | Kes et al. | 235/117 R X |
| 4,347,435 | 8/1982 | Evans et al. | 235/94 R |
| 4,426,574 | 1/1984 | Smilgys | 235/94 R X |

FOREIGN PATENT DOCUMENTS

| | | | |
|---|---|---|---|
| 285612 | 3/1931 | France | 116/327 |

*Primary Examiner*—Benjamin R. Fuller

[57] ABSTRACT

Means is provided for converting a fuel pump mechanism price display for reading in either lower or higher order increments. The number wheel utilized has relatively short and relatively long graduation marks, with the relatively short marks being masked by the selective application of a masking strip transversely across the corresponding window of the pump face plate, to thereby render only the relatively long marks visible.

9 Claims, 6 Drawing Figures

INDICATOR ASSEMBLY FOR USE WITH NUMBER WHEEL

BACKGROUND OF THE INVENTION

In the United States, the accuracy level at which commercial fuel dispensing mechanisms must operate is controlled by federal and/or state regulations. Such regulations now permit a tolerance in the sales cost read-out of a mechanical fuel pump counter that is equal to one-half of the smallest increment effectively displayed on the lowest digit number wheel; it is therefore desirable to limit the display to the largest allowable incremental value. Presently, a one-cent increment is required for fuel unit volume prices of less than one dollar per gallon; two-cent increments are permitted for prices of from one dollar to less than three dollars per gallon; and five-cent increments are allowed for prices of three dollars and higher. Due to pricing uncertainties and expected increases in the cost of fuel, it is desirable to provide means that will obviate the necessity for fundamental equipment modification, to accommodate such fluctuating prices, or by which the need for making such modifications can at least be delayed, so as to thereby minimize the inconvenience and expense entailed.

In U.S. Pat. No. 4,347,435, Evans et al disclose read-out mechanisms for fuel pump counters, in which means is provided for selectively masking the short graduations on the lowest order number wheel, to enable selective reading in either one- or two-cent graduations. While the description of the patent is primarily concerned with the provision of mask means that is selectively mountable by the read mechanism mounting means, other alternatives are disclosed. For example, the patentees suggest use of a wheel having colored increment graduation lines, which can be obscured by a similarly colored transparent mask. However, all approaches disclosed by Evans et al (other than perhaps, that of simply employing a masking tape on the wheel rim) are somewhat complex, and would not appear to be subject to implementation as conveniently as might be desired.

Accordingly, it is an object of the present invention to provide novel means for effectively converting the display of the lowest digit number wheel of a mechanical counter for fuel dispensing mechanisms, which does not necessitate any fundamental or substantial change in the equipment.

It is a more specific object of the invention to provide such means by which lower order and higher order indicia on a single counter wheel can be selectively displayed.

It is also an object to provide such means which is simple, convenient, and relatively inexpensive to produce and to implement.

SUMMARY OF THE INVENTION

It has now been found that the foregoing and related objects of the invention are readily attained in a fuel pump mechanism having a supporting frame and a price display assembly, the latter including a bank of rotatably mounted number wheels, wherein means is provided for selectively masking a portion of the lowest digit wheel. That wheel will, more particularly, have a multiplicity of relatively long graduation marks on its circumferential surface, or rim, which are equidistantly spaced thereabout and which extend substantially to at least one side edge thereof. The rim will also carry a multiplicity of relatively short graduation marks, which are interposed between the relatively long ones and extend substantially to one side edge of the wheel, but short of the opposite side edge thereof. A face plate is disposed over the bank of wheels, and has a window through which part of the rim of the lowest digit wheel is normally visible. Disposed adjacent the window of the face plate is an indicator member, which has index means positioned in front of the lowest digit number wheel for registry with the graduation marks thereon; the masking means provided is adapted for selective mounting transversely across the window of the face plate, in a suitable position for masking the relatively short graduation marks. Thus, the indicator member can be employed selectively either to normally indicate both the relatively long and the relatively short graduation marks or, with the masking means so mounted, to indicate only the relatively long marks.

In certain embodiments of the invention, the indicator member will be affixed on the frame to one side of the face plate window, and will extend laterally therefrom beyond the adjacent side edge of the lowest digit number wheel, to an intermediate point, short of the other side edge. The wheel will be so constructed that the relatively long and relatively short graduation marks will extend substantially to the same, adjacent side edge, with the relatively short marks extending no further than the above-mentioned intermediate point. In such a case the masking means will also be mounted adjacent the "one" side of the window.

The indicator member used may have a substantially transparent portion adjacent its free end, through which the graduation marks will normally be at least partially visible. Suitable masking means may comprise a strip of material that is of a width generally corresponding to the length of the relatively short graduation marks, to which the transparent portion of the indicator member will also generally correspond. Preferably, such an indicator member will have opaque portions inwardly and outwardly of the transparent portion, to provide the index means thereof. In such a mechanism the digits on the number wheel will most desirably be disposed within an imaginary band lying midway between its side edges, with the outwardly disposed opaque portion of the indicator member extending to the "intermediate" point, i.e., substantially to the band.

In other embodiments the indicator member may comprise a panel of transparent material extending laterally across the window, with the index means being provided by an opaque rectilinear line that extends laterally substantially entirely across the panel at a location midway between the transverse edges of the window. The lowest digit number wheel utilized in such a mechanism may have all of its graduation marks extending substantially to the side edge that is adjacent to the "one" side of the window, in which case the suitable position for mounting of the masking means will also be thereadjacent. Alternatively, the wheel may be so constructed that only the relatively long graduation marks extend substantially to the adjacent side edge of the wheel, with the relatively short marks extending substantially to the opposite side edge; thus, the suitable mounting position for the masking means will, in that instance, be adjacent the opposite side of the window.

DETAILED DESCRIPTION OF THE ILLUSTRATED EMBODIMENTS

Figure 1:
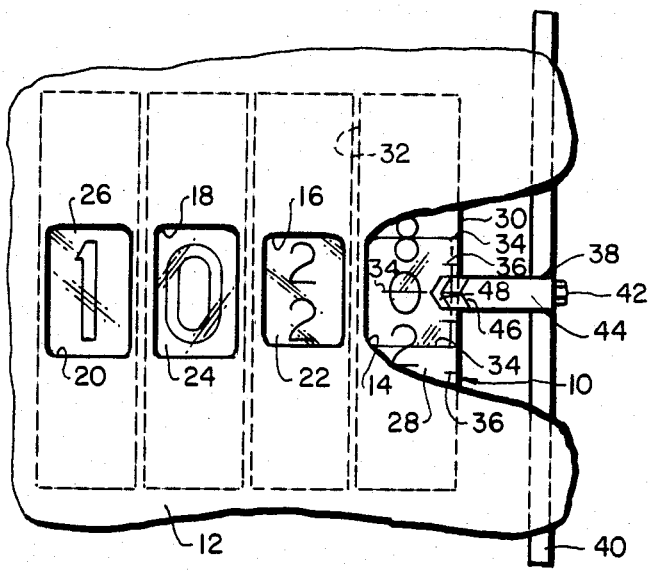
FIG. 1 is a fragmentary front elevational view of a fuel pump mechanism embodying the present invention, with a portion of the face place of the pump housing broken away to shown the structure of the indicator member employed therein.
Figure 2:
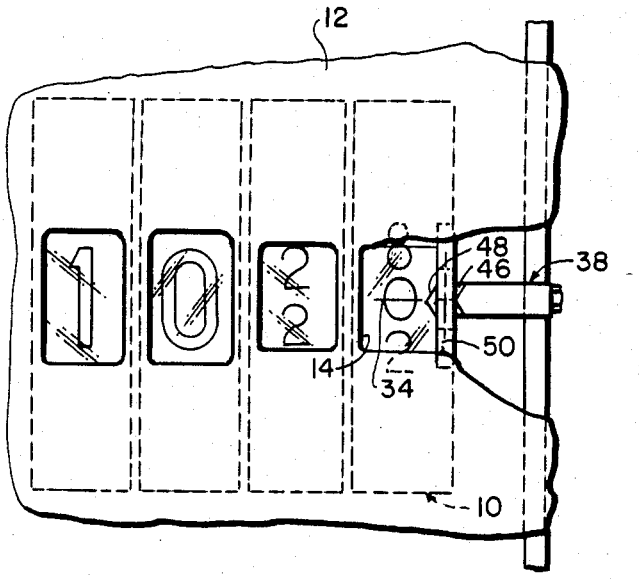
FIG. 2 is a view similar to FIG. 1, with an added strip of masking material placed transversely across the face plate window.

Turning now in detail to FIGS. 1 and 2 of the appended drawings, therein illustrated is a portion of a fuel pump mechanism embodying the present invention, comprised of a bank of number wheels of a mechanical computer, rotatably mounted on a frame portion (not shown) and including a lowest digit number wheel, generally designated by the numeral 10. A face plate 12 (such as may be mounted in the pump housing structure) is disposed in front of the bank of wheels, and has four small windows 14, 16, 18, and 20 formed therein for displaying the indicia on the wheels 10, 22, 24, and 26, respectively; because the face plate 12 is broken away in the region of the lowest digit number wheel 10, the corresponding window 14 is illustrated largely in phantom line.

As will be appreciated, the number wheels cooperate to provide a read-out of the total cost of a fuel sale. The right-hand (lowest digit) number wheel 10 is driven by appropriate connection to a variator mechanism, with rotational movement being transferred from the three lowest order wheels to the adjacent next higher order wheels, again by suitable means. These mechanisms are well known in the art, and do not constitute a novel part of the instant invention.

The circumferential surface or rim 28 of the number wheel 10 has a series of digits printed thereon, which are arranged substantially in an imaginary band that circumscribes the wheel and is centrally disposed between the right and left side edges 30, 32 thereof. A relatively long graduation mark 34 passes laterally through each digit, and extends across the surface 28 from the right-hand edge 30 to a point near the left-hand edge 32 thereof. Interposed between each pair of adjacent relatively long graduation marks 34 are relatively short marks 36, which are also coincident with the right-hand edge 30 but extend only a short distance toward the opposite side; thus, the short marks 36 are confined to a relatively narrow imaginary band adjacent the right-hand margin of the wheel 10.

An indicator, generally designated by the numeral 38, is attached to the frame portion 40 by a small screw 42 or like fastener. The body of the indicator extends laterally from its point of attachment toward the left of the mechanism, and includes an opaque inner portion 44, constituting the major part of its length. A chevron-shaped transparent portion 46 is disposed outwardly adjacent the opaque portion 44, and a relatively narrow chevron-shaped opaque portion 48 is, in turn, disposed adjacent thereto at the tip of the indicator 38. As will be noted, the transparent portion 46 is of a width that corresponds to the length of the relatively short graduation marks 36; also, the chevron-shaped opaque portion 48 lies closely adjacent the imaginary central band on which the numerals are arranged. Although not fully illustrated, it should be appreciated that the numerals and the graduation marks 34, 36 extend about the entire circumference of the wheel, generally in the arrangement shown; the wheel will carry one or more sets of digits (from zero to 10) which may, as shown, be represented only by the even numerals.

With the mechanism conditioned as illustrated in FIG. 1, the indicator 38 will serve to reference all of the graduation marks 34, 36, which will be visible through the transparent portion 46 and indexed by the pointed end of the inward opaque portion 44. The longer marks 34 will, of course, also be visible beyond the tip of the indicator 38, and will be indexed as well by the chevron-shaped outer opaque portion 48.

The mechanism of FIG. 1 is reproduced in FIG. 2, augmented however by the presence of a masking strip 50, which has been applied to the underside of the face plate 12 along the right-hand margin of the window 14. The strip 50 may, for example, comprise a length of opaque tape or like material, having an adhesive surface by which it can readily be secured to the inner surface of the face plate 12, across the window 14. Alternative masking structures will of course readily occur to those skilled in the art, and can be used in appropriate circumstances. The masking strip might also be affixed by more permanent means, and can be applied to the exterior surface of the face plate 12, if so desired, provided that adequate measures are taken to protect the mask against displacement or removal.

In any event, it will be noted that the masking strip 50 will obscure from view the relatively short graduation marks 36, and will render the opaque tip portion 48 of the indicator 38 the only effective reference point. Thus, by the simple expedient of securing the masking strip 50 in the manner illustrated the mechanism can effectively be converted from a one-cent increment display (using the long and the short marks) to a two-cent display (utilizing the long marks alone).

Figure 3:
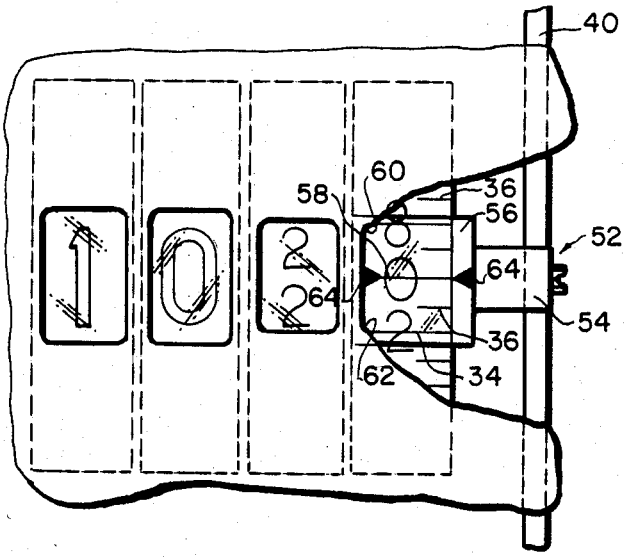
FIG. 3 is a view similar to FIG. 1, in which a second form of the indicator members suitable for use in the present mechanisms is employed.
Figure 4:
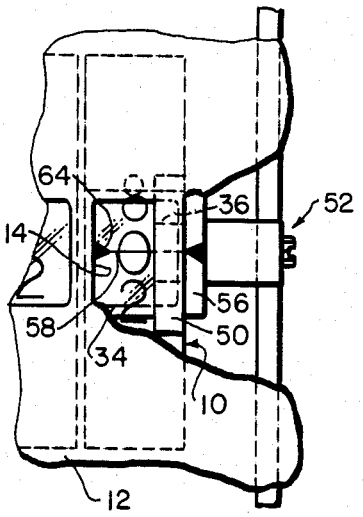
FIG. 4 is a view similar to FIG. 3, showing a smaller fragment of the mechanism, with a masking strip positioned across the face plate window.

The mechanism of FIGS. 3 and 4 embodies the same concepts, and differs from that of the foregoing figures only in the construction of indicator member used. To the extent that the mechanisms of the several figures comprise the same parts, common numbers will be employed throughout for the description.

The indicator member, generally designated by the numeral 52, includes a bracket 54, to which is secured a square panel 56 of transparent material. The panel 56 is dimensioned to span the window 14, and carries an opaque rectilinear line 58 extending laterally across it at a point intermediate the upper and lower (i.e., transverse) edges 60, 62 of the window 14. Triangular opaque elements 64 are provided at the opposite ends of the line 58, each of which has an inwardly directed apex to serve (in cooperation with the line 58) as an index point for the number wheel indicia.

As shown in FIG. 4, the masking strip 50 has been placed transversely across the window 14 adjacent its right-hand margin, thus serving to obscure the relatively short graduation marks 36. As so conditioned, the mechanism will permit the number wheel 10 to be read only in two-cent increments, as the relatively long marks 34 align under the opaque line 58 and also come into direct registry with the left-hand triangular element 64.

Figure 5:
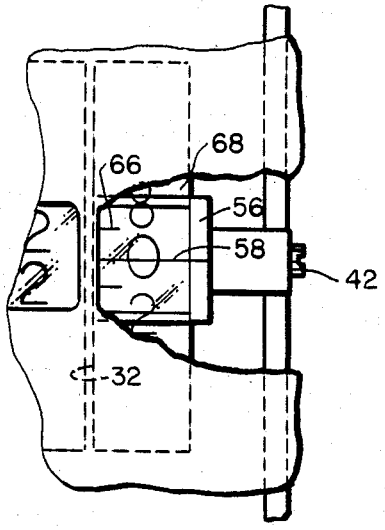
FIG. 5 is a view similar to the foregoing figures, also showing a smaller fragment of the mechanism in which another form of indicator member is used.
Figure 6:
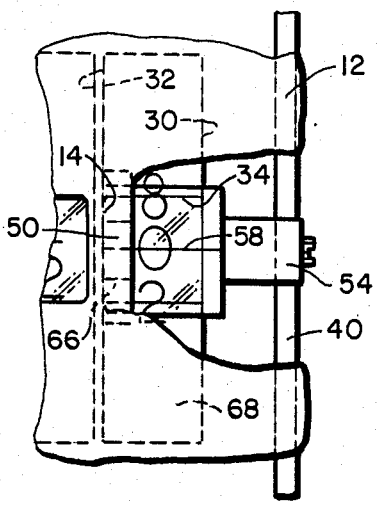
FIG. 6 is another similar view, with the masking strip in place along the margin of the face plate window that is opposite to that of FIGS. 2 and 4.

Turning finally to FIGS. 5 and 6 of the drawings, the indicator 52 is of virtually the same construction as that of FIGS. 3 and 4, with the exception that the triangular elements 64 have been eliminated; thus, it will be clear that they are desirable, but not essential, to the indicator. The more notable feature illustrated in FIGS. 5 and 6 concerns the placement of the relatively short graduation marks 66 on the wheel 68. Whereas the shorter marks 36 on the number wheels 10 of the mechanisms of FIGS. 1–4 extend from the right-hand edge 30, the marks 66 on the wheel 68 extend from the left-hand margin 32. Consequently, in FIG. 6 the masking strip 50 is applied adjacent the left-hand margin of the window 14, so as to position it over the marks 66 when the unit is to be converted to read only in two-cent increments. In all other respects the mechanism of FIGS. 5 and 6 is comparable to those of FIGS. 1–4, the primary purpose of the latter figures being to suggest appropriate variations.

As indicated above, the means by which the shorter graduation marks can be masked can take any of a variety of forms, as will be evident to those skilled in the art. It is, as a practical matter, only necessary that the masking means be capable of selective application or attachment to a face plate disposed in front of the number wheel, to laterally span the corresponding window in a position that is effective to mask the relatively short graduation marks, while leaving the relatively long marks visible through the window. The invention also relies upon the utilization of an indicator member, which preferably has a transparent portion through which the shorter graduation marks can be seen when the masking member is absent, and which has opaque elements or lines to serve as indexing means. Thus, the structure shown in the appended drawings should be regarded as illustrative, and not as limiting upon the scope of the claims.

It should also be appreciated that, although the lowest digit number wheel shown in the appended drawings are all provided with graduation marks at one-cent intervals, and are convertible to provide two-cent increment displays, other number wheel designs (such as for five-cent increments) can be used in the practice of the invention. The arrangment of the relatively long and short marks on the wheel rim will, of course, be chosen to correspond to the pricing scheme involved.

Thus, it can be seen that the present invention provides novel means for converting the display of a lowest digit number wheel, which does not necessitate any fundamental or substantial change to the mechanical counter in which it is employed. By such means, the lower and high order indicia on such a counter wheel can be selectively displayed, and the means is simple, convenient, and inexpensive to produce and to employ.

Having thus described the invention, what is claimed is:

1. In a fuel pump mechanism having supporting frame means and a sale price display assembly, including a bank of number wheels rotatably mounted on said frame means, the improvement comprising: a lowest digit number wheel in said bank having a multiplicity of relatively long graduation marks spaced equidistantly about the circumferential surface and extending substantially to at least one side edge thereof, and having a multiplicity of relatively short graduation marks on said circumferential surface interposed between said relatively long marks and extending substantially to said one side edge and short of the opposite side edge thereof; a face plate disposed over said bank of wheels and having a window through which is normally visible a limited area of said circumferential surface of said lowest digit wheel and said relatively long and relatively short graduation marks thereon; an indicator member disposed adjacent said window and having index means positioned in front of said lowest digit wheel for registry with said relatively long and relatively short graduation marks; and strip means, of a width substantially equal to the length of said relatively short graduation marks, adapted for selective mounting across said window to extend perpendicularly to the axis of rotation of said wheels and at a suitable position for masking said relatively short graduation marks on said lowest digit number wheel, whereby said indicator member can be selectively employed to normally index said relatively long and said relatively short graduation marks, or to index only long graduation marks with said masking means so mounted in said suitable position.

2. The mechanism of claim 1 wherein said indicator member is affixed on said frame means to one side of said window and extends laterally therefrom beyond the adjacent side edge of said lowest digit number wheel to an intermediate point short of the other side edge, said relatively long and said relatively short graduation marks extending substantially to said adjacent side edge and said relatively short marks extending no further than said intermediate point, said suitable position for mounting of said masking means being adjacent said one side of said window.

3. The mechanism of claim 1 wherein said indicator member is affixed on said frame member to one side of said window and comprises a panel of transparent material extending laterally thereacross, an opaque rectilinear line extending laterally substantially entirely across said panel of material at a location midway between the transverse edges of said window providing said pointer means thereon.

4. The mechanism of claim 3 wherein all of said graduation marks extend substantially to the side edge of said lowest digit wheel that is adjacent to said one side of said window, said suitable position for mounting of said masking means also being thereadjacent.

5. The mechanism of claim 3 wherein said relatively long graduation marks extend substantially to the side edge of said lowest digit wheel that is adjacent to said one side of said window, and wherein said relatively short marks extend substantially to the side edge of said wheel adjacent to the opposite side of said window, said suitable position for mounting of said masking means being adjacent said opposite side.

6. The mechanism of claim 3 wherein said index means includes an opaque triangular element at each end of said line having an inwardly apex disposed thereon.

7. In a fuel pump mechanism having supporting frame means and a sale price display assembly, including a bank of number wheels rotatably mounted on said frame means, the improvement comprising: a lowest digit number wheel in said bank having a multiplicity of relatively long graduation marks spaced equidistantly about the circumferential surface and extending substantially to at least one side edge thereof, and having a multiplicty of relatively short graduation marks on said circumferential surface interposed between said relatively long marks and extending substantially to said one side edge and short of the opposite side edge thereof; a face plate disposed over said bank of wheels and having a window through which is normally visible a limited area of said circumferential surface of said lowest digit wheel and said relatively long and relatively short graduation marks thereon; an indicator member disposed adjacent said window, and having index means positioned in front of said lowest digit wheel for registry with said relatively long and relatively short graduation marks, said indicator member being affixed on said frame means to one side of said window and extending laterally therefrom beyond the adjacent side edge, constituting said one side edge, of said lowest digit number wheel to an intermediate point short of said opposite side edge, said indicator member having a substantially transparent portion adjacent its free end through which said graduation marks are normally at least partially visible, and being of a width generally corresponding to the length of said relatively short graduation marks, said relatively short marks extending no further than said intermediate point; and means adapted for selective mounting across said window to extend perpendicularly to the axis of rotation of said number wheels and at a suitable position for masking said relatively short graduation marks on said lowest digit number wheel, said masking means comprising a strip of material that is also substantially of said generally corresponding width, and said suitable position for mounting of said masking means being adjacent said one side of said window; whereby said indicator member can be selectively employed to normally index said relatively long and said relatively short graduation marks, or to index only long graduation marks with said masking means so mounted in said suitable position.

8. The mechanism of claim 7 wherein said indicator member has opaque portions inwardly and outwardly of said transparent portion providing said index means thereof.

9. The mechanism of claim 8 wherein the digits on said lowest digit number wheel are disposed on said circumferential surface generally within an imaginary band lying midway between said side edges, and wherein said outwardly disposed opaque portion of said indicator member extends to said intermediate point and substantially to said band.

* * * * *